US009595263B2

(12) United States Patent
Baeckstroem et al.

(10) Patent No.: US 9,595,263 B2
(45) Date of Patent: Mar. 14, 2017

(54) ENCODING AND DECODING OF PULSE POSITIONS OF TRACKS OF AN AUDIO SIGNAL

(71) Applicant: Fraunhofer-Gesellschaft zur Foerderung der angewandten Forschung e.V., Munich (DE)

(72) Inventors: Tom Baeckstroem, Nuremberg (DE); Guillaume Fuchs, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 33 days.

(21) Appl. No.: 13/966,635

(22) Filed: Aug. 14, 2013

(65) Prior Publication Data

US 2013/0339036 A1 Dec. 19, 2013

Related U.S. Application Data

(63) Continuation of application No. PCT/EP2012/052294, filed on Feb. 10, 2012.
(Continued)

(51) Int. Cl.
*G10L 19/00* (2013.01)
*G10L 19/12* (2013.01)
(Continued)

(52) U.S. Cl.
CPC ..... *G10L 19/00* (2013.01); *G10K 11/16* (2013.01); *G10L 19/005* (2013.01);
(Continued)

(58) Field of Classification Search
CPC ..... G10L 19/10; G10L 19/12
(Continued)

(56) References Cited

U.S. PATENT DOCUMENTS 5,598,506 A 1/1997 Wigren et al.
5,606,642 A 2/1997 Stautner et al.
(Continued)

FOREIGN PATENT DOCUMENTS

AU 2007/312667 4/2008
CA 2730239 A1 1/2010
(Continued)

OTHER PUBLICATIONS

"Digital Cellular Telecommunications System (Phase 2+); Universal Mobile Telecommunications System (UMTS); LTE; Speech codec speech processing functions; Adaptive Multi-Rate-Wideband (AMR-)WB Speech Codec; Transcoding Functions (3GPP TS 26.190 version 9.0.0", Technical Specification, European Telecommunications Standards Institute (ETSI) 650, Route Des Lucioles; F-06921 Sophia-Antipolis; France; No. V.9.0.0, Jan. 1, 2012, 54 Pages.
(Continued)

*Primary Examiner* — Jialong He
(74) *Attorney, Agent, or Firm* — Michael A. Glenn; Perkins Coie LLP

(57) ABSTRACT

An apparatus for decoding an encoded audio signal is provided. The apparatus includes a pulse information decoder and a signal decoder. The pulse information decoder is adapted to decode a plurality of pulse positions, wherein each one of the pulse positions indicates a position of one of the pulses of the track, wherein the pulse information decoder is configured to decode the plurality of pulse positions by using a track positions number, a total pulses number, and one state number. The signal decoder is adapted to decode the encoded audio signal by generating a synthesized audio signal using the plurality of pulse positions and a plurality of predictive filter coefficients.

15 Claims, 7 Drawing Sheets

Related U.S. Application Data

(60) Provisional application No. 61/442,632, filed on Feb. 14, 2011.

(51) Int. Cl.

| | |
|---|---|
| ***G10L 19/012*** | (2013.01) |
| ***G10K 11/16*** | (2006.01) |
| ***G10L 19/005*** | (2013.01) |
| ***G10L 19/03*** | (2013.01) |
| ***G10L 19/22*** | (2013.01) |
| ***G10L 21/0216*** | (2013.01) |
| ***G10L 25/78*** | (2013.01) |
| *G10L 19/26* | (2013.01) |
| *G10L 19/04* | (2013.01) |
| *G10L 19/02* | (2013.01) |
| *G10L 25/06* | (2013.01) |
| *G10L 19/025* | (2013.01) |
| *G10L 19/107* | (2013.01) |

(52) U.S. Cl.
CPC ..... *G10L 19/012* (2013.01); *G10L 19/03* (2013.01); *G10L 19/12* (2013.01); *G10L 19/22* (2013.01); *G10L 21/0216* (2013.01); *G10L 25/78* (2013.01); *G10L 19/025* (2013.01); *G10L 19/0212* (2013.01); *G10L 19/04* (2013.01); *G10L 19/107* (2013.01); *G10L 19/26* (2013.01); *G10L 25/06* (2013.01)

(58) Field of Classification Search
USPC ..... 704/219, 500
See application file for complete search history.

(56) References Cited

U.S. PATENT DOCUMENTS 5,684,920 A 11/1997 Iwakami et al.
5,727,119 A 3/1998 Davidson et al.
5,848,391 A 12/1998 Bosi et al.
5,890,106 A 3/1999 Bosi-Goldberg et al.
5,953,698 A 9/1999 Hayata
5,960,389 A 9/1999 Jarvinen et al.
6,070,137 A 5/2000 Bloebaum et al.
6,134,518 A 10/2000 Cohen et al.
6,173,257 B1 * 1/2001 Gao ..... 704/220
6,236,960 B1 * 5/2001 Peng et al. ..... 704/211
6,532,443 B1 3/2003 Nishiguchi et al.
6,587,817 B1 7/2003 Vähätalo et al.
6,636,829 B1 10/2003 Benyassine et al.
6,636,830 B1 10/2003 Princen et al.
6,680,972 B1 1/2004 Liljeryd et al.
6,757,654 B1 6/2004 Westerlund et al.
6,879,955 B2 4/2005 Rao et al.
6,969,309 B2 11/2005 Carpenter
6,980,143 B2 12/2005 Linzmeier et al.
7,003,448 B1 2/2006 Lauber et al.
7,124,079 B1 10/2006 Johansson et al.
7,249,014 B2 * 7/2007 Kannan et al. ..... 704/219
7,280,959 B2 10/2007 Bessette
7,343,283 B2 3/2008 Ashley et al.
7,363,218 B2 4/2008 Jabri et al.
7,519,535 B2 4/2009 Spindola
7,536,299 B2 5/2009 Cheng et al.
7,565,286 B2 7/2009 Gracie et al.
7,587,312 B2 9/2009 Kim
7,627,469 B2 12/2009 Nettre et al.
7,707,034 B2 4/2010 Sun et al.
7,711,563 B2 5/2010 Chen
7,788,105 B2 * 8/2010 Miseki ..... 704/500
7,801,735 B2 9/2010 Thumpudi et al.
7,809,556 B2 10/2010 Goto et al.
7,860,720 B2 12/2010 Thumpudi et al.
7,873,511 B2 1/2011 Herre et al.
7,877,253 B2 1/2011 Krishnan et al.
7,917,369 B2 3/2011 Lee et al.
7,930,171 B2 4/2011 Chen et al.
7,933,769 B2 4/2011 Bessette
7,979,271 B2 7/2011 Bessette
7,987,089 B2 7/2011 Krishnan et al.
8,045,572 B1 10/2011 Li et al.
8,078,458 B2 12/2011 Zopf et al.
8,121,831 B2 2/2012 Oh et al.
8,160,274 B2 4/2012 Bongiovi
8,239,192 B2 8/2012 Kovesi et al.
8,255,207 B2 8/2012 Vaillancourt et al.
8,255,213 B2 8/2012 Yoshida et al.
8,363,960 B2 1/2013 Petersohn
8,364,472 B2 1/2013 Ehara
8,428,936 B2 4/2013 Mittal et al.
8,428,941 B2 4/2013 Boehm et al.
8,452,884 B2 5/2013 Wang et al.
8,566,106 B2 10/2013 Salami et al.
8,630,862 B2 1/2014 Geiger et al.
8,630,863 B2 1/2014 Son et al.
8,635,357 B2 1/2014 Ebersviller
8,825,496 B2 9/2014 Setiawan et al.
8,954,321 B1 2/2015 Beack et al.
2002/0111799 A1 * 8/2002 Bernard ..... 704/220
2002/0176353 A1 11/2002 Atlas et al.
2002/0184009 A1 12/2002 Heikkinen
2003/0009325 A1 1/2003 Kirchherr et al.
2003/0033136 A1 * 2/2003 Lee ..... 704/2
2003/0046067 A1 * 3/2003 Gradl ..... 704/217
2003/0078771 A1 * 4/2003 Jung ..... G10L 19/00 704/222
2003/0225576 A1 * 12/2003 Li et al. ..... 704/222
2004/0010329 A1 1/2004 Lee et al.
2004/0093204 A1 * 5/2004 Byun ..... G10L 19/107 704/219
2004/0093368 A1 * 5/2004 Lee et al. ..... 708/520
2004/0184537 A1 9/2004 Geiger et al.
2004/0193410 A1 * 9/2004 Lee ..... G10L 19/032 704/219
2004/0220805 A1 11/2004 Geiger et al.
2004/0225505 A1 11/2004 Andersen et al.
2005/0021338 A1 1/2005 Graboi et al.
2005/0065785 A1 * 3/2005 Bessette ..... 704/211
2005/0080617 A1 4/2005 Koshy et al.
2005/0091044 A1 4/2005 Ramo et al.
2005/0096901 A1 * 5/2005 Uvliden et al. ..... 704/219
2005/0130321 A1 6/2005 Nicholson et al.
2005/0154584 A1 7/2005 Jelinek et al.
2005/0165603 A1 7/2005 Bessette et al.
2005/0192798 A1 9/2005 Vainio et al.
2005/0240399 A1 10/2005 Makinen et al.
2005/0278171 A1 12/2005 Suppappola et al.
2006/0095253 A1 5/2006 Schuller et al.
2006/0115171 A1 6/2006 Geiger et al.
2006/0116872 A1 * 6/2006 Byun et al. ..... 704/222
2006/0173675 A1 8/2006 Ojanpera et al.
2006/0206334 A1 9/2006 Kapoor et al.
2006/0210180 A1 9/2006 Geiger et al.
2006/0271356 A1 11/2006 Vos
2006/0293885 A1 12/2006 Gournay et al.
2007/0050189 A1 3/2007 Cruz-Zeno et al.
2007/0100607 A1 5/2007 Villemoes
2007/0147518 A1 6/2007 Bessette et al.
2007/0160218 A1 7/2007 Jakka et al.
2007/0171931 A1 7/2007 Manjunath et al.
2007/0172047 A1 7/2007 Coughlan et al.
2007/0174047 A1 7/2007 Anderson et al.
2007/0196022 A1 8/2007 Geiger et al.
2007/0225971 A1 9/2007 Bessette et al.
2007/0282603 A1 * 12/2007 Bessette ..... G10L 19/0208 704/219
2008/0010064 A1 1/2008 Takeuchi et al.
2008/0015852 A1 1/2008 Kruger et al.
2008/0027719 A1 1/2008 Kirshnan et al.
2008/0046236 A1 2/2008 Thyssen et al.
2008/0052068 A1 2/2008 Aguilar et al.
2008/0097764 A1 4/2008 Grill et al.
2008/0120116 A1 5/2008 Schnell et al.
2008/0147415 A1 6/2008 Schnell et al.

(56) References Cited

U.S. PATENT DOCUMENTS

| | | | |
|---|---|---|---|
| 2008/0208599 | A1 | 8/2008 | Rosec et al. |
| 2008/0221905 | A1 | 9/2008 | Schnell et al. |
| 2008/0249765 | A1 | 10/2008 | Schuijers et al. |
| 2008/0275580 | A1 | 11/2008 | Andersen |
| 2009/0024397 | A1 | 1/2009 | Ryu et al. |
| 2009/0076807 | A1 | 3/2009 | Xu et al. |
| 2009/0110208 | A1 | 4/2009 | Choo et al. |
| 2009/0204412 | A1 | 8/2009 | Kovesi et al. |
| 2009/0226016 | A1 | 9/2009 | Fitz et al. |
| 2009/0228285 | A1 | 9/2009 | Schnell et al. |
| 2009/0319283 | A1 | 12/2009 | Schnell et al. |
| 2009/0326930 | A1 | 12/2009 | Kawashima et al. |
| 2009/0326931 | A1 | 12/2009 | Ragot et al. |
| 2010/0017200 | A1 | 1/2010 | Oshikiri et al. |
| 2010/0017213 | A1 | 1/2010 | Edler et al. |
| 2010/0049511 | A1* | 2/2010 | Ma ..... G10L 19/08 704/221 |
| 2010/0063811 | A1 | 3/2010 | Gao et al. |
| 2010/0063812 | A1 | 3/2010 | Gao |
| 2010/0070270 | A1 | 3/2010 | Gao |
| 2010/0106496 | A1 | 4/2010 | Morii et al. |
| 2010/0138218 | A1 | 6/2010 | Geiger et al. |
| 2010/0198586 | A1 | 8/2010 | Edler et al. |
| 2010/0217607 | A1 | 8/2010 | Neuendorf et al. |
| 2010/0262420 | A1 | 10/2010 | Herre et al. |
| 2010/0268542 | A1 | 10/2010 | Kim et al. |
| 2011/0002393 | A1 | 1/2011 | Suzuki et al. |
| 2011/0007827 | A1 | 1/2011 | Virette et al. |
| 2011/0106542 | A1 | 5/2011 | Bayer et al. |
| 2011/0153333 | A1 | 6/2011 | Bessette |
| 2011/0173010 | A1 | 7/2011 | Lecomte et al. |
| 2011/0173011 | A1 | 7/2011 | Geiger et al. |
| 2011/0178795 | A1 | 7/2011 | Bayer et al. |
| 2011/0218797 | A1 | 9/2011 | Mittal et al. |
| 2011/0218799 | A1 | 9/2011 | Mittal et al. |
| 2011/0218801 | A1 | 9/2011 | Vary et al. |
| 2011/0257979 | A1 | 10/2011 | Gao |
| 2011/0270616 | A1 | 11/2011 | Garudadri et al. |
| 2011/0311058 | A1 | 12/2011 | Oh et al. |
| 2012/0226505 | A1 | 9/2012 | Lin et al. |
| 2012/0271644 | A1 | 10/2012 | Bessette et al. |
| 2013/0332151 | A1 | 12/2013 | Fuchs et al. |
| 2014/0257824 | A1 | 9/2014 | Taleb et al. |

FOREIGN PATENT DOCUMENTS

| | | | |
|---|---|---|---|
| CN | 1274456 | A | 11/2000 |
| CN | 1344067 | A | 4/2002 |
| CN | 1381956 | A | 11/2002 |
| CN | 1437747 | A | 8/2003 |
| CN | 1539137 | A | 10/2004 |
| CN | 1539138 | A | 10/2004 |
| CN | 101351840 | | 10/2006 |
| CN | 101110214 | A | 1/2008 |
| CN | 101366077 | A | 2/2009 |
| CN | 101371295 | A | 2/2009 |
| CN | 101379551 | A | 3/2009 |
| CN | 101388210 | A | 3/2009 |
| CN | 101425292 | A | 5/2009 |
| CN | 101483043 | A | 7/2009 |
| CN | 101488344 | A | 7/2009 |
| CN | 101743587 | | 6/2010 |
| CN | 101770775 | A | 7/2010 |
| DE | 102008015702 | A1 | 8/2009 |
| EP | 0665530 | A1 | 8/1995 |
| EP | 0673566 | A1 | 9/1995 |
| EP | 0758123 | A2 | 2/1997 |
| EP | 0784846 | A1 | 7/1997 |
| EP | 0843301 | B1 | 5/1998 |
| EP | 1120775 | A1 | 8/2001 |
| EP | 1852851 | | 7/2007 |
| EP | 1845520 | A1 | 10/2007 |
| EP | 2107556 | | 7/2009 |
| EP | 2109098 | A2 | 10/2009 |
| EP | 2144230 | A1 | 1/2010 |
| FR | 2911228 | A1 | 7/2008 |
| JP | H08263098 | A | 10/1996 |
| JP | 10039898 | A | 2/1998 |
| JP | H10214100 | A | 8/1998 |
| JP | H11502318 | A | 2/1999 |
| JP | H1198090 | A | 4/1999 |
| JP | 2000357000 | A | 12/2000 |
| JP | 2002-118517 | | 4/2002 |
| JP | 2003501925 | A | 1/2003 |
| JP | 2003506764 | A | 2/2003 |
| JP | 2004513381 | A | 4/2004 |
| JP | 2004514182 | A | 5/2004 |
| JP | 2005534950 | A | 11/2005 |
| JP | 2006504123 | A | 2/2006 |
| JP | 2007065636 | A | 3/2007 |
| JP | 2007523388 | A | 8/2007 |
| JP | 2007525707 | A | 9/2007 |
| JP | 2007538282 | A | 12/2007 |
| JP | 2008-15281 | | 1/2008 |
| JP | 2008513822 | A | 5/2008 |
| JP | 2008261904 | A | 10/2008 |
| JP | 2009508146 | A | 2/2009 |
| JP | 2009075536 | A | 4/2009 |
| JP | 2009522588 | A | 6/2009 |
| JP | 2009-527773 | | 7/2009 |
| JP | 2010530084 | | 9/2010 |
| JP | 2010-538314 | | 12/2010 |
| JP | 2010539528 | A | 12/2010 |
| JP | 2011501511 | A | 1/2011 |
| JP | 2011527444 | A | 10/2011 |
| KR | 1020040043278 | A | 5/2004 |
| KR | 1020060025203 | A | 3/2006 |
| KR | 1020070088276 | A | 8/2007 |
| KR | 20080032160 | A | 4/2008 |
| KR | 1020100059726 | A | 6/2010 |
| RU | 2169992 | C2 | 6/2001 |
| RU | 2183034 | C2 | 5/2002 |
| RU | 2003118444 | A | 12/2004 |
| RU | 2004138289 | A | 6/2005 |
| RU | 2296377 | C2 | 3/2007 |
| RU | 2302665 | C2 | 7/2007 |
| RU | 2312405 | C2 | 12/2007 |
| RU | 2331933 | C2 | 8/2008 |
| RU | 2335809 | C2 | 10/2008 |
| RU | 2008126699 | A | 2/2010 |
| RU | 2009107161 | A | 9/2010 |
| RU | 2009118384 | A | 11/2010 |
| TW | 200830277 | | 10/1996 |
| TW | 200943279 | | 10/1998 |
| TW | 201032218 | | 9/1999 |
| TW | 380246 | B | 1/2000 |
| TW | 469423 | B | 12/2001 |
| TW | I253057 | B | 4/2006 |
| TW | 200703234 | A | 1/2007 |
| TW | 200729156 | A | 8/2007 |
| TW | 200943792 | A | 10/2009 |
| TW | I316225 | B | 10/2009 |
| TW | I 320172 | | 2/2010 |
| TW | 201009810 | A | 3/2010 |
| TW | 201009812 | A | 3/2010 |
| TW | I324762 | B | 5/2010 |
| TW | 201027517 | A | 7/2010 |
| TW | 201040943 | | 11/2010 |
| TW | 201103009 | | 1/2011 |
| WO | 92/22891 | A1 | 12/1992 |
| WO | 95/10890 | A1 | 4/1995 |
| WO | 95/30222 | A1 | 11/1995 |
| WO | 96/29696 | A1 | 9/1996 |
| WO | 00/31719 | A2 | 6/2000 |
| WO | 0075919 | A1 | 12/2000 |
| WO | 02/101724 | A1 | 12/2002 |
| WO | WO-02101722 | | 12/2002 |
| WO | 2005/041169 | A2 | 5/2005 |
| WO | 2005078706 | A1 | 8/2005 |
| WO | 2005081231 | A1 | 9/2005 |
| WO | 2005112003 | A1 | 11/2005 |
| WO | 2006082636 | A1 | 8/2006 |
| WO | 2006126844 | A2 | 11/2006 |

(56) References Cited

FOREIGN PATENT DOCUMENTS

| | | | |
|---|---|---|---|
| WO | WO-2007051548 | | 5/2007 |
| WO | WO-2007073604 | | 7/2007 |
| WO | WO2007/096552 | | 8/2007 |
| WO | WO-2008013788 | | 10/2008 |
| WO | 2008/157296 | A1 | 12/2008 |
| WO | WO-2009029032 | | 3/2009 |
| WO | 2009077321 | A3 | 10/2009 |
| WO | 2009121499 | A1 | 10/2009 |
| WO | 2010/003563 | A1 | 1/2010 |
| WO | 2010003491 | A1 | 1/2010 |
| WO | WO-2010/003491 | | 1/2010 |
| WO | WO-2010003532 | | 1/2010 |
| WO | WO-2010040522 | | 4/2010 |
| WO | 2010059374 | A1 | 5/2010 |
| WO | 2010/081892 | A2 | 7/2010 |
| WO | 2010093224 | A2 | 8/2010 |
| WO | 2011/006369 | A1 | 1/2011 |
| WO | 2011/048117 | A1 | 4/2011 |
| WO | WO-2011048094 | | 4/2011 |
| WO | 2011/147950 | A1 | 12/2011 |
| WO | WO2012022881 | | 2/2012 |

OTHER PUBLICATIONS

"IEEE Signal Processing Letters", IEEE Signal Processing Society. vol. 15. ISSN 1070-9908., 2008, 9 Pages.

"Information Technology—MPEG Audio Technologies—Part 3: Unified Speech and Audio Coding", ISO/IEC JTC 1/SC 29 ISO/IEC DIS 23003-3, Feb. 9, 2011, 233 Pages.

"WD7 of USAC", International Organisation for Standardisation Organisation Internationale De Normailisation. ISO/IEC JTC1/SC29/WG11. Coding of Moving Pictures and Audio. Dresden, Germany., Apr. 2010, 148 Pages.

3GPP, , "3rd Generation Partnership Project; Technical Specification Group Service and System Aspects. Audio Codec Processing Functions. Extended AMR Wideband Codec; Transcoding functions (Release 6).", 3GPP Draft; 26.290, V2.0.0 3rd Generation Partnership Project (3GPP), Mobile Competence Centre; Valbonne, France., Sep. 2004, pp. 1-85.

Ashley, J et al., "Wideband Coding of Speech Using a Scalable Pulse Codebook", 2000 IEEE Speech Coding Proceedings., Sep. 17, 2000, pp. 148-150.

Bessette, B et al., "The Adaptive Multirate Wideband Speech Codec (AMR-WB)", IEEE Transactions on Speech and Audio Processing, IEEE Service Center. New York. vol. 10, No. 8., Nov. 1, 2002, pp. 620-636.

Bessette, B et al., "Universal Speech/Audio Coding Using Hybrid ACELP/TCX Techniques", ICASSP 2005 Proceedings. IEEE International Conference on Acoustics, Speech, and Signal Processing, vol. 3,, Jan. 2005, pp. 301-304.

Bessette, B et al., "Wideband Speech and Audio Codec at 16/24/32 Kbit/S Using Hybrid ACELP/TCX Techniques", 1999 IEEE Speech Coding Proceedings. Porvoo, Finland., Jun. 20, 1999, pp. 7-9.

Ferreira, A et al., "Combined Spectral Envelope Normalization and Subtraction of Sinusoidal Components in the ODFTand MDCT Frequency Domains", 2001 IEEE Workshop on Applications of Signal Processing to Audio and Acoustics., Oct. 2001, pp. 51-54.

Fischer, et al., "Enumeration Encoding and Decoding Algorithms for Pyramid Cubic Lattice and Trellis Codes", IEEE Transactions on Information Theory. IEEE Press, USA, vol. 41, No. 6, Part 2., Nov. 1, 1995, pp. 2056-2061.

Hermansky, H et al., "Perceptual linear predictive (PLP) analysis of speech", J. Acoust. Soc. Amer. 87 (4)., Apr. 1990, pp. 1738-1751.

Hofbauer, K et al., "Estimating Frequency and Amplitude of Sinusoids in Harmonic Signals—A Survey and the Use of Shifted Fourier Transforms", Graz: Graz University of Technology; Graz University of Music and Dramatic Arts; Diploma Thesis, Apr. 2004, 111 pages.

Lanciani, C et al., "Subband-Domain Filtering of MPEG Audio Signals", 1999 IEEE International Conference on Acoustics, Speech, and Signal Processing. Phoenix, AZ, USA., Mar. 15, 1999, pp. 917-920.

Lauber, P et al., "Error Concealment for Compressed Digital Audio", Presented at the 111th AES Convention. Paper 5460. New York, USA., Sep. 21, 2001, 12 Pages.

Lee, Ick Don et al., "A Voice Activity Detection Algorithm for Communication Systems with Dynamically Varying Background Acoustic Noise", Dept. of Electrical Engineering, 1998 IEEE, May 18-21, 1998, pp. 1214-1218.

Makinen, J et al., "AMR-WB+: a New Audio Coding Standard for 3rd Generation Mobile Audio Services", 2005 IEEE International Conference on Acoustics, Speech, and Signal Processing. Philadelphia, PA, USA., Mar. 18, 2005, 1109-1112.

Motlicek, P et al., "Audio Coding Based on Long Temporal Contexts", Rapport de recherche de l'IDIAP 06-30, Apr. 2006, pp. 1-10.

Neuendorf, M et al., "A Novel Scheme for Low Bitrate Unified Speech Audio Coding—MPEG RMO", AES 126th Convention. Convention Paper 7713. Munich, Germany, May 1, 2009, 13 Pages.

Neuendorf, M et al., "Completion of Core Experiment on unification of USAC Windowing and Frame Transitions", International Organisation for Standardisation Organisation Internationale De Normalisation ISO/IEC JTC1/SC29/WG11. Coding of Moving Pictures and Audio. Kyoto, Japan., Jan. 2010, 52 Pages.

Neuendorf, M et al., "Unified Speech and Audio Coding Scheme for High Quality at Low Bitrates", ICASSP 2009 IEEE International Conference on Acoustics, Speech and Signal Processing. Piscataway, NJ, USA., Apr. 19, 2009, 4 Pages.

Patwardhan, P et al., "Effect of Voice Quality on Frequency-Warped Modeling of Vowel Spectra", Speech Communication. vol. 48, No. 8., Aug. 2006, pp. 1009-1023.

Ryan, D et al., "Reflected Simplex Codebooks for Limited Feedback MIMO Beamforming", IEEE. XP31506379A., Jun. 14-18, 2009, 6 Pages.

Sjoberg, J et al., "RTP Payload Format for the Extended Adaptive Multi-Rate Wideband (AMR-WB+) Audio Codec", Memo. The Internet Society. Network Working Group. Category: Standards Track., Jan. 2006, pp. 1-38.

Terriberry, T et al., "A Multiply-Free Enumeration of Combinations with Replacement and Sign", IEEE Signal Processing Letters. vol. 15, 2008, 11 Pages.

Terriberry, T et al., "Pulse Vector Coding", Retrieved from the internet on Oct. 12, 2012. XP55025946. URL:http://people.xiph.org/~tterribe/notes/cwrs.html, Dec. 1, 2007, 4 Pages.

Virette, D et al., "Enhanced Pulse Indexing CE for ACELP in USAC", Organisation Internationale De Normalisation ISO/IEC JTC1/SC29/WG11. MPEG2012/M19305. Coding of Moving Pictures and Audio. Daegu, Korea., Jan. 2011, 13 Pages.

Wang, F et al., "Frequency Domain Adaptive Postfiltering for Enhancement of Noisy Speech", Speech Communication 12. Elsevier Science Publishers. Amsterdam, North-Holland. vol. 12, No. 1., Mar. 1993, 41-56.

Waterschoot, T et al., "Comparison of Linear Prediction Models for Audio Signals", EURASIP Journal on Audio, Speech, and Music Processing. vol. 24., Dec. 2008, 27 pages.

Zernicki, T et al., "Report on CE on Improved Tonal Component Coding in eSBR", International Organisation for Standardisation Organisation Internationale De Normalisation ISO/IEC JTC1/SC29/WG11. Coding of Moving Pictures and Audio. Daegu, South Korea, Jan. 2011, 20 Pages.

A Silence Compression Scheme for G.729 Optimized for Terminals Conforming to Recommendation V.70, ITU-T Recommendation G.729—Annex B, International Telecommunication Union, Nov. 1996, pp. 1-16.

Martin, R., Spectral Subtraction Based on Minimum Statistics, Proceedings of European Signal Processing Conference (EUSIPCO), Edinburg, Scotland, Great Britain, Sep. 1994, pp. 1182-1185.

3GPP, TS 26.290 version 9.0.0 (Jan. 2010), Digital cellular telecommunications system (Phase 2+), Universal Mobile Telecommunications System (UMTS); LTE; Audio codec processing functions; Extended Adaptive Multi-Rate-Wideband (AMR-WB+) codec;

(56) References Cited

OTHER PUBLICATIONS

Transcoding functions (3GPP TS 26.290 version 9.0.0 release 9), Chapter 5.3, Jan. 2010, pp. 24-39.
Britanak, et al., "A new fast algorithm for the unified forward and inverse MDCT/MDST computation", Signal Processing, vol. 82, Mar. 2002, pp. 433-459.
Herley, C. et al., "Tilings of the Time-Frequency Plane: Construction of Arbitrary Orthogonal Bases and Fast Tilings Algorithms", IEEE Transactions on Signal Processing , vol. 41, No. 12, Dec. 1993, pp. 3341-3359.
Lefebvre, R. et al., "High quality coding of wideband audio signals using transform coded excitation (TCX)", 1994 IEEE International Conference on Acoustics, Speech, and Signal Processing, Apr. 19-22, 1994, pp. I/193 to I/196 (4 pages).
Fuchs, et al., "MDCT-Based Coder for Highly Adaptive Speech and Audio Coding", 17th European Signal Processing Conference (EUSIPCO 2009), Glasgow, Scotland, Aug. 24-28, 2009, pp. 1264 - 1268.
Song, et al., "Research on Open Source Encoding Technology for MPEG Unified Speech and Audio Coding", Journal of the Institute of Electronics Engineers of Korea vol. 50 No. 1, Jan. 2013, pp. 86 - 96.

* cited by examiner

ENCODING AND DECODING OF PULSE POSITIONS OF TRACKS OF AN AUDIO SIGNAL

CROSS-REFERENCE TO RELATED APPLICATIONS

This application is a continuation of copending International Application No. PCT/EP2012/052294, filed Feb. 10, 2012, which is incorporated herein by reference in its entirety, and additionally claims priority from U.S. Application No. 61/442,632, filed Feb. 14, 2011, which is also incorporated herein by reference in its entirety.

BACKGROUND OF THE INVENTION

The present invention relates to the field of audio processing and audio coding, in particular to encoding and decoding of pulse positions of tracks in an audio signal.

Audio processing and/or coding has advanced in many ways. In audio coding, linear predictive coders play an important role. When encoding an audio signal, e.g. an audio signal comprising speech, linear predictive encoders usually encode a representation of the spectral envelope of the audio signal. To this end, linear predictive encoders may determine predictive filter coefficients to represent the spectral envelope of sound in encoded form. The filter coefficients may then be used by a linear predictive decoder to decode the encoded audio signal by generating a synthesized audio signal using the predictive filter coefficients.

Important examples for linear predictive coders are ACELP coders (ACELP=Algebraic Code-Exited Linear Prediction coders). ACELP coders are widely used, for example, in USAC (USAC=Unified Speech and Audio Coding) and may have further application fields, for example in LD-USAC (Low Delay Unified Speech and Audio Coding).

ACELP encoders usually encode an audio signal by determining predictive filter coefficients. To achieve better encoding, ACELP encoders determine a residual signal, also referred to as target signal, based on the audio signal to be encoded, and based on the already determined predictive filter coefficients. The residual signal may, for example, be a difference signal representing a difference between the audio signal to be encoded and the signal portions that are encoded by the predictive filter coefficients, and, possibly, by adaptive filter coefficients resulting from a pitch analysis. The ACELP encoder then aims to encode the residual signal. For this, the encoder encodes algebraic codebook parameters, which are used to encode the residual signal.

To encode the residual signal, algebraic codebooks are used. Usually, algebraic codebooks comprise a plurality of tracks, for example, four tracks each comprising 16 track positions. In such a configuration, a total of $4 \cdot 16=64$ sample positions can be represented by a respective algebraic codebook, for example, corresponding to the number of samples of a subframe of the audio signal to be encoded.

The tracks of the codebook may be interleaved such that track 0 of the codebook may represent samples 0, 4, 8, . . . , 60 of the subframe, such that track 1 of the codebook may represent samples 1, 5, 9, . . . , 61 of the subframe, such that track 2 of the codebook may represent samples 2, 6, 10, . . . , 62 of the subframe, and such that track 3 of the codebook may represent samples 3, 7, 11, . . . , 63 of the subframe. Each track may have a fixed number of pulses. Or, the number of pulses per track may vary, e.g.

depending on other conditions. A pulse may, for example, be positive or negative, e.g. may be represented by +1 (positive pulse) or 0 (negative pulse).

For encoding the residual signal, when encoding, a codebook configuration may be chosen, that best represents the remaining signal portions of the residual signal. For this, the available pulses may be positioned at suitable track positions that reflect best the signal portions to be encoded. Moreover, it may be specified, whether a corresponding pulse is positive or negative.

On a decoder side, an ACELP decoder would at first decode the algebraic codebook parameters. The ACELP decoder may also decode the adaptive codebook parameters. To determine the algebraic codebook parameters, the ACELP decoder may determine the plurality of pulse positions for each track of an algebraic codebook. Moreover, the ACELP decoder may also decode, whether a pulse at a track position is a positive or a negative pulse. Furthermore, the ACELP decoder may also decode the adaptive codebook parameters. Based on this information, the ACELP decoder usually generates an excitation signal. The ACELP decoder then applies the predictive filter coefficients on the excitation signal to generate a synthesized audio signal to obtain the decoded audio signal.

In ACELP, pulses on a track are generally encoded as follows. If the track is of length 16 and if the number of pulses on this track is one, then we can encode the pulse position by its position (4 bits) and sign (1 bit), totaling 5 bits. If the track is of length 16 and the number of pulses is two, then the first pulse is encoded by its position (4 bits) and sign (1 bit). For the second pulse we need to encode the position only (4 bits), since we can choose that the sign of the second pulse is positive if it is to the left of the first pulse, negative if it is to the right of the first pulse and the same sign as the first pulse if it is at the same position as the first pulse. In total, we therefore need 9 bits to encode 2 pulses. In comparison to encoding the pulse positions separately, by 5 bits each, we thus save 1 bit for every pair of pulses.

Encoding a larger number of pulses than 2, we can encode pulses pair-wise and if the number of pulses is odd, encode the last pulse separately. Then, for example, for a track of 5 pulses, we would need $9+9+5=23$ bits. If we have 4 tracks, then $4 \times 23=92$ bits would be necessitated for encoding a subframe of length 64 with 4 tracks and 5 pulses per track. However, it would be very appreciated, if the number of bits could furthermore be reduced.

It would be very appreciated, if an apparatus for encoding and a respective apparatus for decoding with improved encoding or decoding concepts would be provided, which have means to encode or decode pulse information in an improved way using fewer bits for pulse information representation, as this would, for example, reduce the transmission rate for transmitting a respectively encoded audio signal, and as furthermore, this would, for example, reduce the storage needed to store a respectively encoded audio signal.

SUMMARY

According to an embodiment, an apparatus for decoding an encoded audio signal, wherein one or more tracks are associated with the encoded audio signal, each one of the tracks having a plurality of track positions and a plurality of pulses, may have: a pulse information decoder for decoding a plurality of pulse positions, wherein each one of the pulse positions indicates one of the track positions of one of the tracks to indicate a position of one of the pulses of the track, and wherein the pulse information decoder is configured to decode the plurality of pulse positions by using a track positions number indicating a total number of the track positions of at least one of the tracks, a total pulses number indicating a total number of the pulses of at least one of the tracks, and one state number; and a signal decoder for decoding the encoded audio signal by generating a synthesized audio signal using the plurality of pulse positions and a plurality of predictive filter coefficients being associated with the encoded audio signal, wherein the pulse information decoder is furthermore adapted to decode a plurality of pulse signs using the track positions number, the total pulses number and the state number, wherein each one of the pulse signs indicates a sign of one of the plurality of pulses, and wherein the signal decoder is adapted to decode the encoded audio signal by generating a synthesized audio signal furthermore using the plurality of pulse signs.

According to another embodiment, an apparatus for encoding an audio signal may have: a signal processor for determining a plurality of predictive filter coefficients being associated with the audio signal, for generating a residual signal based on the audio signal and the plurality of predictive filter coefficients; and a pulse information encoder for encoding a plurality of pulse positions relating to one or more tracks, to encode the audio signal, the one or more tracks being associated with the residual signal, each one of the tracks having a plurality of track positions and a plurality of pulses, wherein each one of the pulse positions indicates one of the track positions of one of the tracks to indicate a position of one of the pulses of the track, wherein the pulse information encoder is configured to encode the plurality of pulse positions by generating a state number, such that the pulse positions can be decoded only based on the state number, a track positions number indicating a total number of the track positions of at least one of the tracks, and a total pulses number indicating a total number of the pulses of at least one of the tracks, wherein the pulse information encoder is configured to add an integer value to an intermediate number for each pulse at a track position for each track position of one of the tracks, to obtain the state number.

According to another embodiment, a method for decoding an encoded audio signal, wherein one or more tracks are associated with the encoded audio signal, each one of the tracks having a plurality of track positions and a plurality of pulses, may have the steps of: decoding a plurality of pulse positions, wherein each one of the pulse positions indicates one of the track positions of one of the tracks to indicate a position of one of the pulses of the track, and wherein the plurality of pulse positions are decoded by using a track positions number indicating a total number of the track positions of at least one of the tracks, a total pulses number indicating a total number of the pulses of at least one of the tracks, and one state number, decoding a plurality of pulse signs using the track positions number, the total pulses number and the state number, wherein each one of the pulse signs indicates a sign of one of the plurality of pulses, and decoding the encoded audio signal by generating a synthesized audio signal using the plurality of pulse positions and a plurality of predictive filter coefficients being associated with the encoded audio signal, wherein decoding the encoded audio signal is conducted by generating a synthesized audio signal furthermore using the plurality of pulse signs.

According to another embodiment, a method for encoding an audio signal may have the steps of: determining a plurality of predictive filter coefficients being associated with the audio signal, for generating a residual signal based on the audio signal and the plurality of predictive filter coefficients; and encoding a plurality of pulse positions relating to one or more tracks, to encode the audio signal, the one or more tracks being associated with the residual signal, each one of the tracks having a plurality of track positions and a plurality of pulses, wherein each one of the pulse positions indicates one of the track positions of one of the tracks to indicate a position of one of the pulses of the track, wherein the plurality of pulse positions are encoded by generating a state number, such that the pulse positions can be decoded only based on the state number, a track positions number indicating a total number of the track positions of at least one of the tracks, and a total pulses number indicating a total number of the pulses of at least one of the tracks, wherein encoding a plurality of pulse positions is conducted by adding an integer value to an intermediate number for each pulse at a track position for each track position of one of the tracks, to obtain the state number.

Another embodiment may have a computer program implementing the inventive methods when being executed on a computer or signal processor.

According to embodiments, it is assumed that one state number is available for an apparatus for decoding. It is furthermore assumed that a track positions number, indicating the total number of track positions of at least one of the tracks associated with the encoded audio signal, and a total pulses number, indicating the number of pulses of at least one of the tracks, is available for a decoding apparatus of the present invention. Advantageously, the track positions number and the total pulses number is available for each track associated with an encoded audio signal.

For example, having 4 tracks with 5 pulses, each can attain roughly 6.6×10^21 states, which can, according to embodiments, be encoded by 73 bits, which is approximately 21% more efficient than the encoding of the above-described state-of-the-art encoder using 92 bits.

At first, a concept is provided how to encode a plurality of pulse positions of a track of an audio signal in an efficient way. In the following, the concept is extended to allow to encode not only the position of the pulses of a track, but also whether the pulse is positive or negative. Furthermore, the concept is then extended to allow to encode pulse information for a plurality of tracks in an efficient manner. The concepts are correspondingly applicable on a decoder side.

In addition, the embodiments are, moreover, based on the finding, that, if the encoding strategy uses a pre-determined number of bits, such that any configuration with the same number of pulses on each track necessitates the same number of bits. If the number of bits available is fixed, it is then possible directly to choose how many pulses can be encoded with the given amount of bits thus enabling encoding with a pre-determined quality. Moreover, with this approach, it is not necessitated to try different amounts of pulses until the desired bit-rate is achieved, but we can directly choose the right amount of pulses, thereby reducing complexity.

Based on the above assumptions, the plurality of pulse positions of a track of an audio signal frame may be encoded and/or decoded.

While the present invention can be employed for encoding or decoding any kind of audio signals, for example, speech signals or music signals, the present invention is particularly useful for encoding or decoding speech signals.

In another embodiment, the pulse information decoder is furthermore adapted to decode a plurality of pulse signs using the track positions number, the total pulses number and the state number, wherein each one of the pulse signs indicates a sign of one of the plurality of pulses. The signal decoder may be adapted to decode the encoded audio signal by generating a synthesized audio signal furthermore using the plurality of pulse signs.

According to a further embodiment, wherein the one or more tracks may comprise at least a last track and one or more other tracks, the pulse information decoder may be adapted to generate a first substrate number and a second substrate number from the state number. The pulse information decoder may be configured to decode a first group of the pulse positions based on the first substrate number, and the pulse information decoder may furthermore be configured to decode a second group of the pulse positions based on the second substrate number. The second group of the pulse positions may only consist of pulse positions indicating track positions of the last track. The first group of the pulse positions only consists of pulse positions indicating track positions of the one or more other tracks.

According to another embodiment, the pulse information decoder may be configured to separate the state number into the first substrate number and the second substrate number by dividing the state number by $f(p_k, N)$ to obtain an integer part and a remainder as a division result, wherein the integer part is the first substrate number and wherein the remainder is the second substrate number, wherein $p_k$ indicates for each one of the one or more tracks the number of pulses, and wherein N indicates for each one of the one or more tracks the number of track positions. Here, $f(p_k, N)$ is a function that returns the number of states that can be achieved in a track of length N with $p_k$ pulses.

In another embodiment, the pulse information decoder may be adapted to conduct a test comparing the state number or an updated state number with a threshold value.

The pulse information decoder may be adapted to conduct the test by comparing, whether the state number or an updated state number is greater than, greater than or equal to, smaller than, or smaller than or equal to the threshold value, and wherein the analyzing unit is furthermore adapted to update the state number or an updated state number depending on the result of the test.

In an embodiment, the pulse information decoder may be configured to compare the state number or the updated state number with the threshold value for each track position of one of the plurality of tracks.

According to an embodiment, the pulse information decoder may be configured to divide one of the tracks into a first track partition, comprising at least one track position of the plurality of track positions, and into a second track partition, comprising the remaining other track positions of the plurality of track positions. The pulse information decoder may be configured to generate a first substrate number and a second substrate number based on the state number. Moreover, the pulse information decoder may be configured to decode a first group of pulse positions associated with the first track partition based on the first substrate number. Furthermore, the pulse information decoder may be configured to decode a second group of pulse positions associated with the second track partition based on the second substrate number.

According to an embodiment, an apparatus for encoding an audio signal is provided. The apparatus comprises a signal processor adapted to determine a plurality of predictive filter coefficients being associated with the audio signal, for generating a residual signal based on the audio signal and the plurality of predictive filter coefficients. Moreover, the apparatus comprises a pulse information encoder adapted to encode a plurality of pulse positions relating to one or more tracks to encode the audio signal, the one or more tracks being associated with the residual signal. Each one of the tracks has a plurality of track positions and a plurality of pulses. Each one of the pulse positions indicates one of the track positions of one of the tracks to indicate a position of one of the pulses of the track. The pulse information encoder is configured to encode the plurality of pulse positions by generating a state number, such that the pulse positions can be decoded only based on the state number, a track positions number indicating a total number of the track positions of at least one of the tracks, and a total pulses number indicating a total number of the pulses of at least one of the tracks.

According to another embodiment, the pulse information encoder may be adapted to encode a plurality of pulse signs, wherein each one of the pulse signs indicates a sign of one of the plurality of pulses. The pulse information encoder may furthermore be configured to encode the plurality of pulse signs by generating the state number, such that the pulse signs can be decoded only based on the state number, the track positions number indicating a total number of the track positions of at least one of the tracks, and the total pulses number.

In an embodiment, the pulse information encoder is adapted to add an integer value to an intermediate number for each pulse at a track position for each track position of one of the tracks, to obtain the state number.

According to another embodiment, the pulse information encoder may be configured to divide one of the tracks into a first track partition, comprising at least one track position of the plurality of track positions, and into a second track partition, comprising the remaining other track positions of the plurality of track positions. Moreover, the pulse information encoder may be configured to encode a first substrate number associated with the first partition. Furthermore, the pulse information encoder may be configured to encode a second substrate number associated with the second partition. Moreover, the pulse information encoder may be configured to combine the first substrate number and the second substrate number to obtain the state number.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
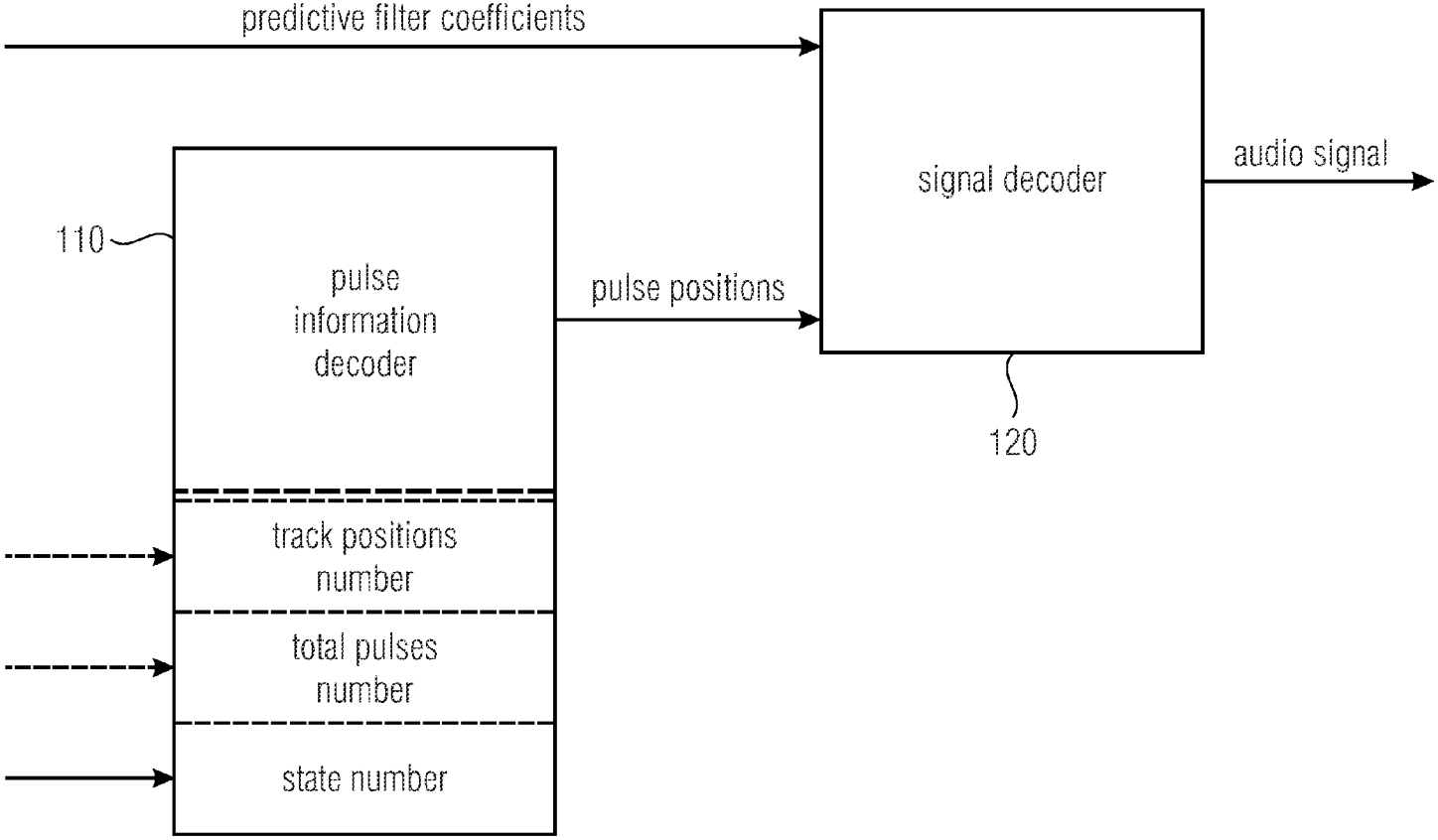
FIG. 1 illustrates an apparatus for decoding an encoded audio signal according to an embodiment.

FIG. 1 illustrates an apparatus for decoding an encoded audio signal, wherein one or more tracks are associated with the encoded audio signal, each one of the tracks having a plurality of track positions and a plurality of pulses.

The apparatus comprises a pulse information decoder 110 and a signal decoder 120. The pulse information decoder 110 is adapted to decode a plurality of pulse positions. Each one of the pulse positions indicates one of the track positions of one of the tracks to indicate a position of one of the pulses of the track.

The pulse information decoder 110 is configured to decode the plurality of pulse positions by using a track positions number indicating a total number of the track positions of at least one of the tracks, a total pulses number indicating a total number of the pulses of at least one of the tracks, and one state number.

The signal decoder 120 is adapted to decode the encoded audio signal by generating a synthesized audio signal using the plurality of pulse positions and a plurality of predictive filter coefficients being associated with the encoded audio signal.

The state number is a number that may have been encoded by an encoder according the embodiments that will be described below. The state number, e.g. comprises information about a plurality of pulse positions in a compact representation, e.g. a representation that necessitates few bits, and that can be decoded, when the information about the track positions number and the total pulses number is available at the decoder.

In an embodiment, the track positions number and/or the total pulses number of one or of each track of the audio signal may be available at the decoder, because the track positions number and/or the total pulses number is a static value that doesn't change and is known by the receiver. For example, the track positions number may be 16 for each track and the total pulses number may be 4.

In another embodiment, the track positions number and/or the total pulses number of one or of each track of the audio signal may be explicitly transmitted to the apparatus for decoding, e.g. by the apparatus for encoding.

In a further embodiment, the decoder may determine the track positions number and/or the total pulses number of one or of each track of the audio signal by analyzing other parameters that do not explicitly state the track positions number and/or the total pulses number, but from which the track positions number and/or the total pulses number can be derived.

In other embodiments, the decoder may analyze other data available to derive the track positions number and/or the total pulses number of one or of each track of the audio signal.

In further embodiment, the pulse information decoder may be adapted to also decode, whether a pulse is a positive pulse or a negative pulse.

In another embodiment, the pulse information decoder may furthermore be adapted to decode pulse information which comprises information about pulses for a plurality of tracks. Pulse information may, for example, be information about the position of the pulses in a track and/or information whether a pulse is a positive pulse or a negative pulse.

Figure 2:
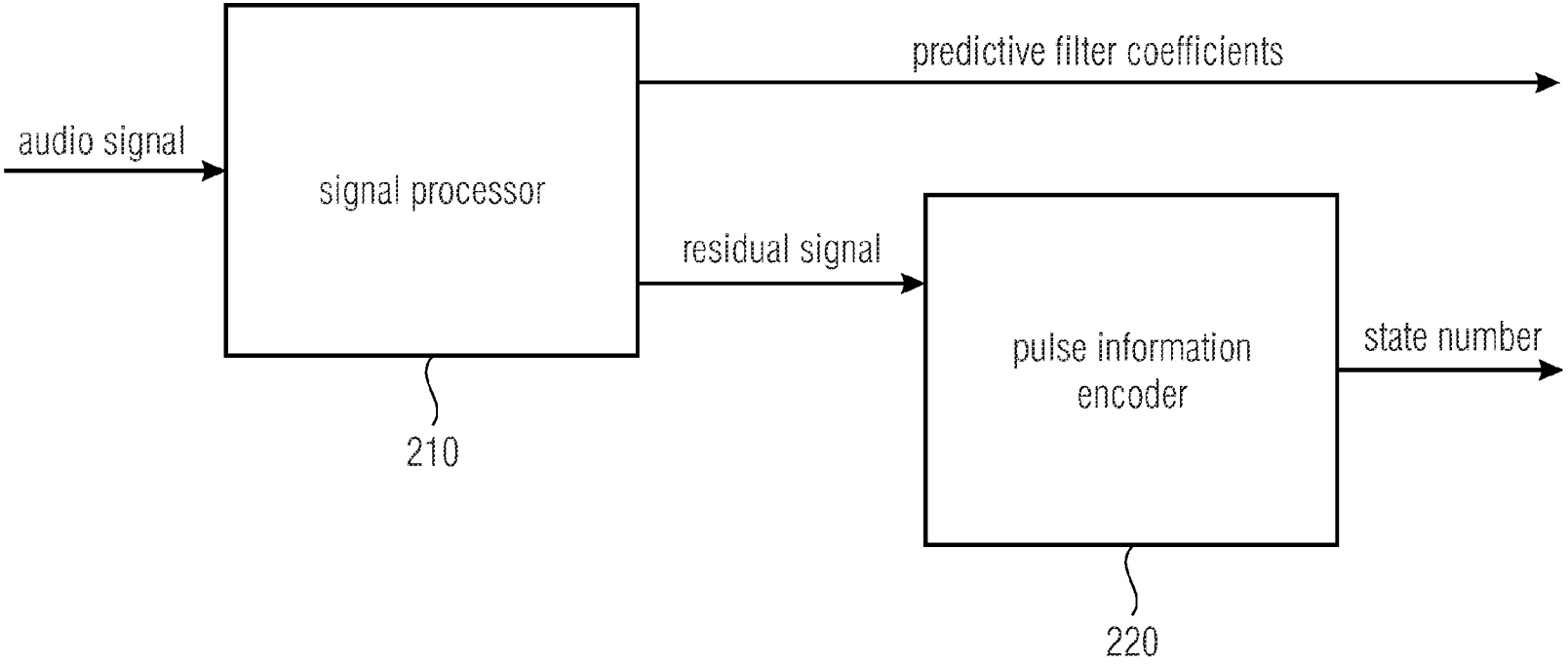
FIG. 2 illustrates an apparatus for encoding an audio signal according to an embodiment.

FIG. 2 illustrates an apparatus for encoding an audio signal, comprising a signal processor 210 and a pulse information encoder 220.

The signal processor 210 is adapted to determine a plurality of predictive filter coefficients being associated with the audio signal, for generating a residual signal based on the audio signal and the plurality of predictive filter coefficients.

The pulse information encoder 220 is adapted to encode a plurality of pulse positions relating to one or more tracks to encode the audio signal. The one or more tracks are associated with the residual signal generated by the signal processor 210. Each one of the tracks has a plurality of track positions and a plurality of pulses. Moreover, each one of the pulse positions indicates one of the track positions of one of the tracks to indicate a position of one of the pulses of the track.

The pulse information encoder 220 is configured to encode the plurality of pulse positions by generating a state number, such that the pulse positions can be decoded only based on the state number, a track positions number indicating a total number of the track positions of at least one of the tracks, and a total pulses number indicating a total number of the pulses of at least one of the tracks.

In the following, the basic concepts of embodiments of the present invention relating to the encoding of the pulse positions and possibly pulse sign (positive pulse or negative pulse) by generating a state number are presented.

The encoding principles of embodiments of the present invention are based on the finding that if a state enumeration of all possible configurations of k pulses in a track with n track positions is considered, it is sufficient to encode the actual state of the pulses of a track. Encoding such a state by as little bits as possible provides the desirable compact encoding. By this, a concept of state enumeration is presented, wherein each constellation of pulse positions, and possibly also pulse signs, represents one state and each state is uniquely enumerated.

Figure 3:
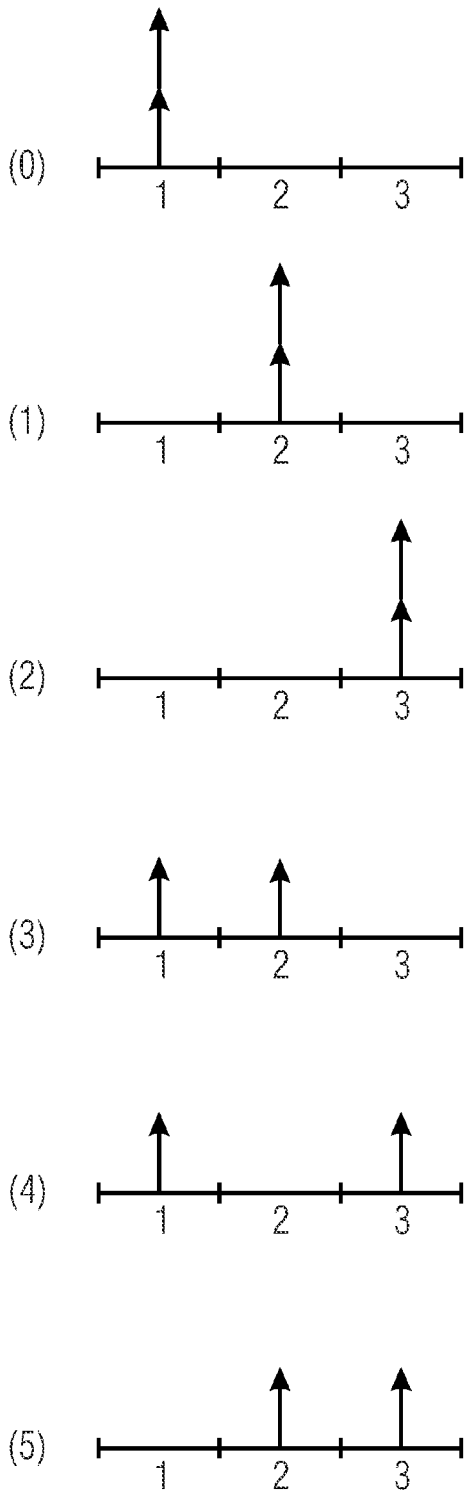
FIG. 3 illustrates all possible configurations, for a track having two unsigned pulses and three track positions.

FIG. 3 illustrates this for a simple case, where all possible configurations are depicted, when a track having two pulses and three track positions is considered. Two pulses may be located at the same track position. In the example of FIG. 3, the sign of the pulses (e.g. whether the pulse is positive or negative) is not considered, e.g. in such an example, all pulses may, for example, be considered to be positive.

In FIG. 3, all possible states for two undirected pulses located in a track with three track positions (in FIG. 3: track positions 1, 2 and 3) are illustrated. There are only six different possible states (in FIG. 3 enumerated from 0 to 5) that describe, how the pulses may be distributed in the track. By this, it is sufficient to use a state number in the range 0 to 5 to describe the actual configuration present. For example, if the state number in the example of FIG. 3 has the value (4), and if the decoder is aware of the encoding scheme, the decoder can conclude that state number=4 means, that the track has one pulse at track position 0 and another pulse at track position 2. By this, in the example of FIG. 3, three bits are sufficient to encode the state number to identify one of the six different states of the example of FIG. 3.

Figure 4:
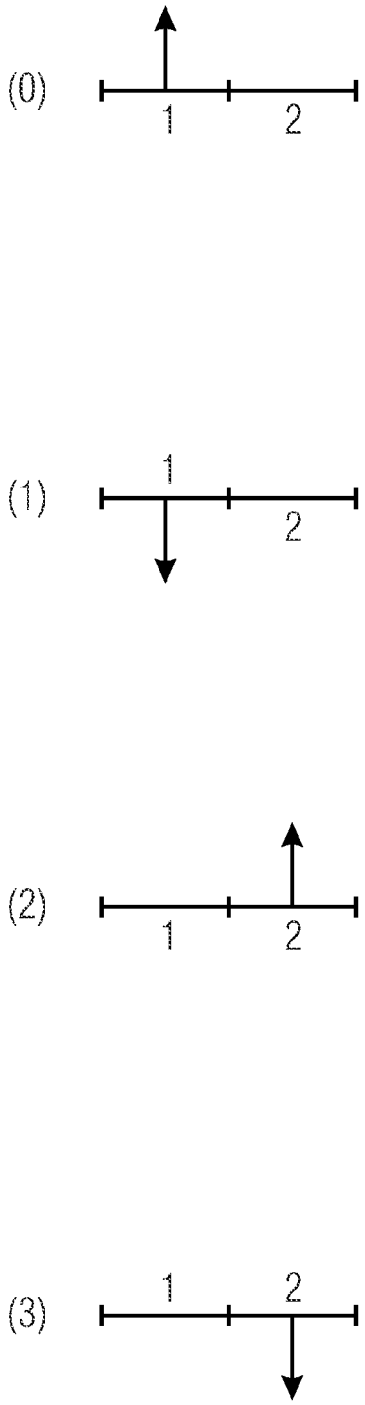
FIG. 4 illustrates all possible configurations, for a track having one signed pulse and two track positions.

FIG. 4 illustrates a case depicting all possible states for one directed pulse located in a track with two track positions (in FIG. 4: track positions 1 and 2). In FIG. 4, the sign of the pulses (e.g. whether the pulse is positive or negative) is considered. There are four different possible states (in FIG. 4 enumerated from 0 to 3) that describe, how the pulse may be distributed in track and also its sign (positive or negative). It is sufficient to use a state number in the range 0 to 3 to describe the actual configuration present. For example, if the state number in the example of FIG. 4 has the value (2), and if the decoder is aware of the encoding scheme, the decoder can conclude that state number=2 means, that the track has one pulse at track position 1, and that the pulse is a positive pulse.

Figure 5:
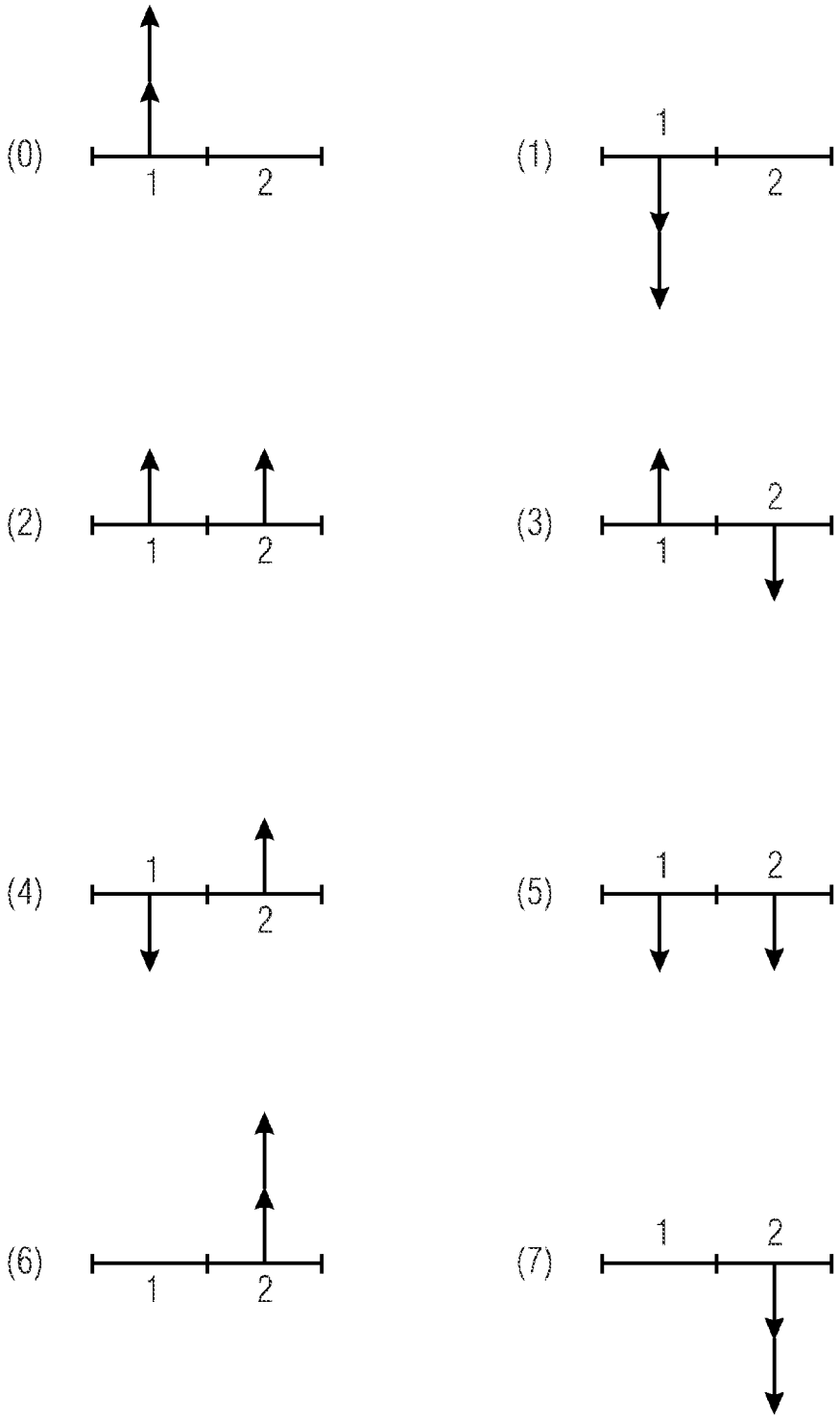
FIG. 5 illustrates all possible configurations, for a track having two signed pulses and two track positions.

FIG. 5 illustrates a still further case, where all possible configurations are depicted, when a track having two pulses and two track positions is considered. Pulses may be located at the same track position. In the example shown in FIG. 5, the sign of the pulses (e.g. whether the pulse is positive or negative) is considered. It is assumed that pulses at the same track position have the same sign (e.g. the tracks at the same track position are either all positive or are all negative).

In FIG. 5, all possible states for two signed pulses (e.g. pulses that are either positive or negative) located in a track with two track positions (in FIG. 5: track positions 1 and 2) are illustrated. There are only eight different possible states (in FIG. 5 enumerated from 0 to 7) that describe, how the pulses may be distributed in the track. By this, it is sufficient to use a state number in the range 0 to 7 to describe the actual configuration. For example, if the state number in the example of FIG. 5 has the value (3), and if the decoder is aware of the encoding scheme, the decoder can conclude that state number=3 means, that the track has one pulse at track position 0 which is positive and another pulse at track position 1 which is negative. By this, in the example of FIG. 5, three bits are sufficient to encode the state number to identify one of the eight different states of the example of FIG. 5.

In ACELP, the residual signal may be encoded by a fixed number of signed pulses. As described above, the pulses may, for example, be distributed in four interlacing tracks, such that track 0 contains positions mod(n,4)==0, track=1 contains positions mod(n,4)==1, and so on. Each track may have a predefined number of signed unit pulses, which may overlap, but when they overlap, the pulses have the same sign.

By encoding pulses, a mapping from the pulse positions and their signs, into a representation that uses the smallest possible amount of bits should be achieved. In addition, the pulse coding should have a bit consumption that is fixed, that is, any pulse constellation has the same number of bits.

Each track is first independently encoded and then the states of each track are combined to one number, which represents the state of the whole subframe. This approach gives the mathematically optimal bit-consumption, given that all states have equal probability, and the bit consumption is fixed.

The concept of state enumeration may also be explained using a compact representation of the different state constellations:

Let the residual signal, which we want to code, be $x_n$. Assuming that four interleaved tracks, e.g. of an algebraic codebook, are considered, then the first track has samples $x_0$, $x_4$, $x_8$ . . . $x_{N-4}$, the second track has samples $x_1$, $x_5$, $x_9$ . . . $x_{N-3}$, etc. Suppose, the first track is quantized with one signed unit pulse and that T=8, whereby the length of the track is 2 (T=length (samples) of the residual signal to be encoded). If T=8, and if 4 tracks are used to encode the residual signal, each one of the 4 tracks has 2 track positions. For example, the first track may be considered, that has two track positions x0 and x4. The pulse of the first track can then appear in any of the following constellations:

| | | | | |
|---|---|---|---|---|
| $x_0$ | +1 | −1 | 0 | 0 |
| $x_4$ | 0 | 0 | +1 | −1 |

There are four different states for this configuration.

Similarly, if there would be two pulses in the first track, the first track having two track positions x0 and x4, the pulses could then be assigned in the following constellations:

| | | | | | | | | |
|---|---|---|---|---|---|---|---|---|
| $x_0$ | +2 | −2 | +1 | +1 | −1 | −1 | 0 | 0 |
| $x_4$ | 0 | 0 | +1 | −1 | +1 | −1 | +2 | −2 |

Thereby this configuration has 8 states.

If the length of the residual signal is extended to T=12, then each of the 4 tracks has 3 track positions. The first track gets one more sample and has now track positions x0, x4 and x8, such that we have:

| | | | | | |
|---|---|---|---|---|---|
| $x_0$, $x_4$ | 2 pulses<br>8 states | 1 pulse<br>4 states | 1 pulse<br>4 states | 0 pulses<br>1 state | 0 pulses<br>1 state |
| $x_8$ | 0 | +1 | −1 | +2 | −2 |

The above table means that there are 8 different states for x0 and x4, if x8=0 (x8 has no pulse); 4 different states for x0 and x4, if x8=1 (x8 has a positive pulse); 4 different states for x0 and x4, if x8=−1 (x8 has a negative pulse); 1 state for x0 and x4, if x8=2 (x8 has two positive pulses); and 1 state for x0 and x4, if x8=−2 (x8 has two negative pulses).

Here, the number of states for the first row has been obtained from the two previous tables. By addition of the number of states in the first row, we see that this configuration has 18 states.

In the T=12 example, 5 bits are sufficient to encode all the 18 different possible states. The encoder then, for example, selects the state number from the range [0, . . . , 17] to specify one of the 18 configurations. If the decoder is aware of the encoding scheme, e.g. if it is aware, which state number represents which configuration, it can decode the pulse positions and pulse signs for a track.

Below, suitable encoding methods and corresponding decoding methods according to embodiments will be provided. According to embodiments, an apparatus for encoding is provided which is configured to execute one of the encoding methods presented below. Moreover, according to further embodiments, an apparatus for decoding is provided which is configured to execute one of the decoding methods presented below.

In embodiments, to generate the state number or to decode the state number, the number of possible configurations for N track positions having p pulses may be calculated.

Pulses may be signed, and a recursive formula may be employed, which calculates the number of states f(p, N) for a track having N track positions and p signed pulses (the pulses may be positive or negative, but pulses at the same track position have the same sign), wherein the recursive formula f(p, N) is defined by:

$$f(p, N) = \sum_{k=0}^{p} f(k, N-1) f(p-k, 1) \qquad \text{Formula 1}$$

The initial conditions are $$f(p, 1) = \begin{cases} 2 & \text{for } p \geq 1 \\ 1 & \text{for } p = 0 \end{cases} \text{ and } f(p, 0) = 0$$

since a single position with one or more pulses necessitates one bit (two states) for the sign. The recursion formula is for summation of all different constellations.

Namely, given p pulses, the current position can have $q_N$=0 to p pulses, whereby the remaining N−1 positions have $p-q_N$ pulses. The number of states at the current position and the remaining N−1 positions are multiplied to obtain the number of states with these combinations of pulses and combinations are summed to obtain the total number of states.

In embodiments, the recursive function may be calculated by an iterative algorithm, wherein the recursion is replaced by iteration.

As the evaluation of f(p, N) is numerically relatively complex for real time applications, according to some embodiments, a table look-up may be employed to calculate f(p,N). According to some embodiments, the table may have been computed off-line.

In the following, further concepts are provided for encoding and decoding the state number:

Let f(p, N) denote the number of possible configurations for a track having N track positions and p signed pulses.

The pulse information encoder can now analyze the track: If the first position in the track does not have a pulse, then the remaining N−1 positions have p signed pulses, and to describe this constellation, we need only f(p, N−1) states.

Otherwise, if the first position has one or more pulses, the pulse information encoder can define that the overall state is greater than f(p, N−1).

Then, at the pulse information decoder, the pulse information decoder, can, for example, start with the last position and compare the state with a threshold value, e.g. with f(p, N−1). If it is greater, then the pulse information decoder can determine that the last position has at least one pulse. The pulse information decoder can then update the state to obtain an updated state number by subtracting f(p, N−1) from the state and reduce the number of remaining pulses by one.

Otherwise, if there is no pulse at the last position, the pulse information decoder can reduce the number of remaining positions by one. Repeating this procedure until there are no pulses left, would provide the unsigned positions of pulses.

To also take the signs of the pulses into account, the pulse information encoder may encode the pulses in the lowest bit of the state. In an alternative embodiment, the pulse information encoder may encode the sign in the highest remaining bit of the state. It is advantageous, however, to encode the pulse sign in the lowest bit, as this is easier to handle with respect to integer computations.

If, in the pulse information decoder, the first pulse of a given position is found, the sign of the pulse is determined by the last bit. Then, the remaining state is shifted one step right to obtain an updated state number.

In an embodiment, a pulse information decoder is configured to apply the following decoding algorithm. In this decoding algorithm, in a step-by-step approach, for each track position, e.g. one after the other, the state number or the updated state number is compared with a threshold value, e.g. with f(p, k−1).

According to an embodiment, a pulse information decoder algorithm is provided:

```
For each position in track, k=N to 1
    While state s >= f(p,k − 1)
        Put a pulse at k
        Set s := s − f(p,k − 1)
        If this is the first pulse at k
            If lowest bit of s is set, set sign to minus
            Otherwise, set sign to plus
            Shift state right one step s := s/2
        Reduce the number of remaining pulses p := p − 1
```

Regarding the pulse information, according to an embodiment, a pulse information encoder is configured to apply the following encoding algorithm. The pulse information encoder does the same steps as the pulse information decoder, but in reverse order.

According to an embodiment, a pulse information encoder algorithm is provided:

```
Set number of found pulses to zero, p:=0 and state to zero, s:=0
For each position in track, k=1 to N
    For each pulse at this position
        If the current pulse is the last one on this position
            Shift state left one step s := s * 2
            If sign is minus, set the lowest bit to one, s := s + 1
            Otherwise set the lowest bit to zero (i.e. do nothing)
        Update the state s := s+ f(p,k − 1)
        Increase the number of found pulses p:=p+1
```

Encoding the state number by using this algorithm, the pulse information encoder adds an integer value to an intermediate number (e.g. an intermediate state number), e.g. the state number before the algorithm is completed, for each pulse at a track position for each track position of one of the tracks, to obtain (the value of) the state number.

The approach for encoding and decoding of pulse information, e.g. pulse positions and pulse signs, may be referred to as "step-by-step encoding" and "step-by-step decoding", as the track positions are considered by the encoding and decoding methods one after the other, step-by-step.

Figure 6:
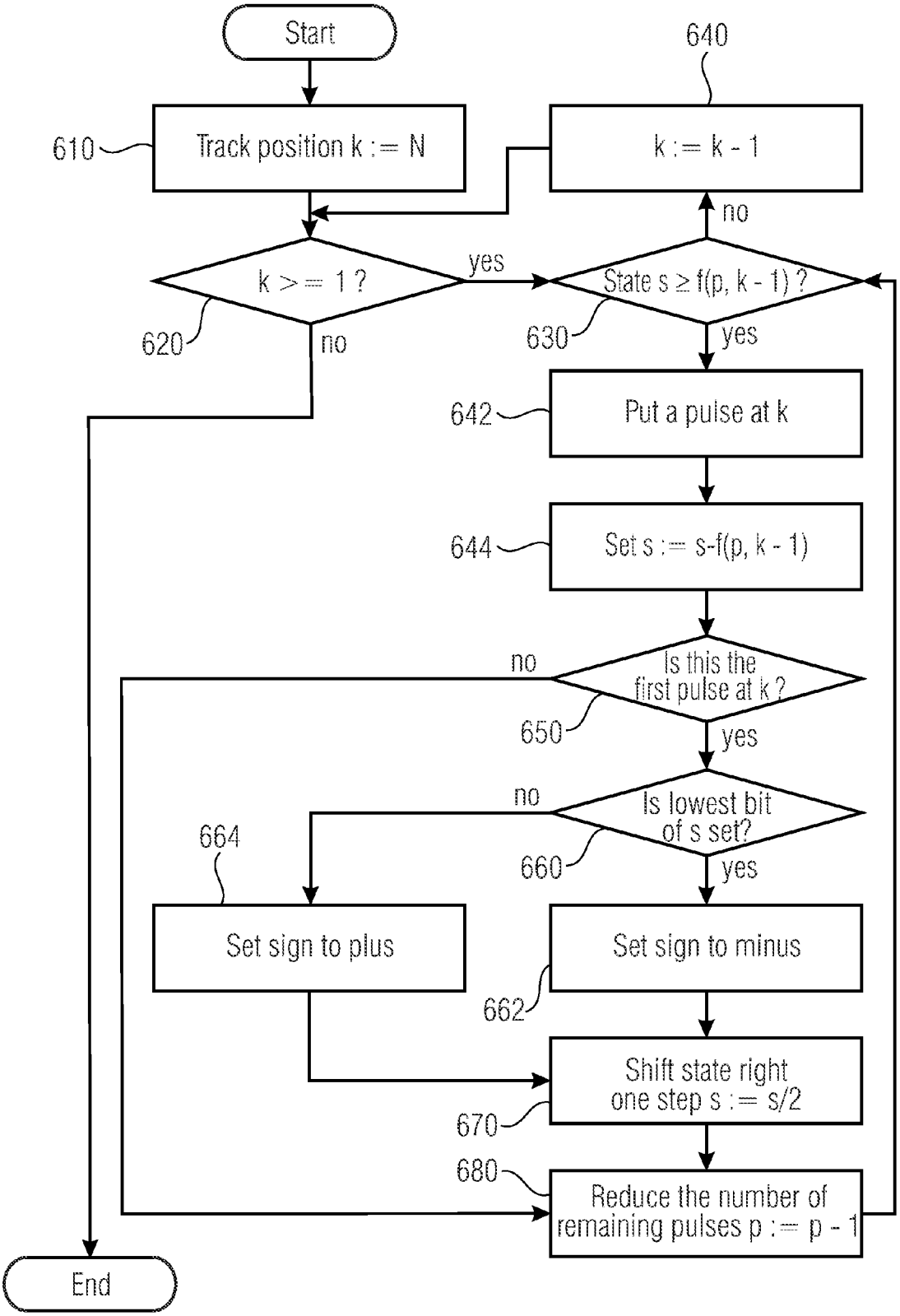
FIG. 6 is a flow chart illustrating an embodiment, depicting the processing steps conducted by a pulse information decoder according to an embodiment.

FIG. 6 is a flow chart illustrating an embodiment, depicting the processing steps conducted by a pulse information decoder according to an embodiment.

In step 610 the current track position k is set to N. Here, N represents the number of track positions of a track, wherein the track positions are enumerated from 1 to N.

In step 620, it is tested, whether k is greater than or equal to 1, i.e. whether track positions remain that have not been considered. If k is not greater than or equal to 1, all track positions have been considered and the process ends.

Otherwise it is tested in step 630, whether the state is greater than or equal to f(p, k−1). If this is the case, at least one pulse is present at position k. If this is not the case, no (further) pulse is present at track position k and the process continues at 640, where k is reduced by 1, such that the next track position will be considered.

If, however, the state is greater than or equal to f(p, k−1), the process continues with step 642, a pulse is put at track position k, and then, in step 644, the state is updated by reducing the state by f(p, k−1). Then, in step 650, it is tested, whether the current pulse is the first discovered pulse at track position k. If this is not the case, the number of remaining pulses is reduced by 1 in step 680, and the process continues in step 630.

If, however this is the first discovered pulse at track position k, the process continues with step 660, where it is tested, whether the lowest bit of s is set. If this is the case, the sign of the pulses at this track position is set to minus (step 662), otherwise, the sign of the pulses at this track position is set to plus (step 664). In both cases, the state is then shifted one step right in step 670 (s:=s/2). Then, also, the number of remaining pulses is reduced by one (step 680) and the process continues at step 630.

Figure 7:
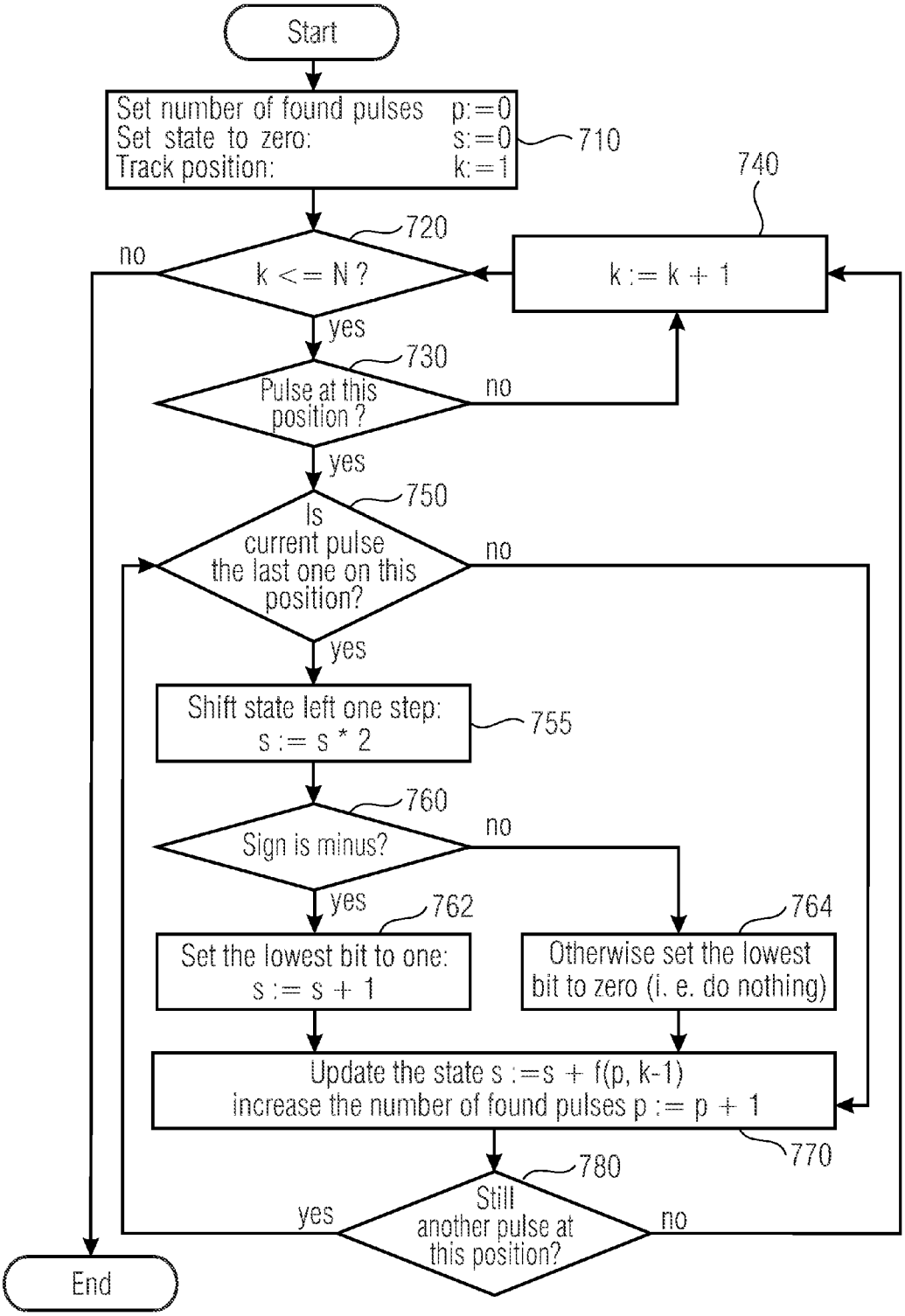
FIG. 7 is a flow chart illustrating an embodiment, the flow chart depicting the processing steps conducted by a pulse information encoder according to an embodiment.

FIG. 7 is a flow chart illustrating an embodiment, the flow chart depicting the processing steps conducted by a pulse information encoder according to an embodiment.

In step 710, the number of found pulses p is set to 0, the state s is set to 0 and the considered track position k is set to 1.

In step 720, it is tested, whether k is smaller than or equal to N, i.e. whether track positions remain that have not been considered (here, N means: number of track positions of a track). If k is not smaller than or equal to N, all track positions have been considered and the process ends.

Otherwise it is tested in step 730, whether at least one pulse is present at position k. If this is not the case, the process continues at 740, where k is increased by 1, such that the next track position will be considered.

However, if at least one pulse is present at track position k, it is tested in step 750, whether the currently considered pulse is the last pulse at track position k. If this is not the case, then, in step 770, the state s is updated by adding f(p, k−1) to the state s, the number of found pulses p is increased by 1, and the process continues with step 780.

If the currently considered pulse is the last pulse at track position k, then after step 750, the process continues with step 755 and the state is shifted one step left (s:=s*2). Then, it is tested in step 760, whether the sign of the pulse is minus. If this is the case, the lowest bit of s is set to 1 (step 762); otherwise, the lowest bit of s is set to 0 (or nothing is done) (step 764). Then, in both cases, step 770 is conducted, where the state s is updated by adding f(p, k−1) to the state s, the number of found pulses p is increased by 1, and the process continues with step 780.

In step 780, it is tested, whether there is another pulse at position k. If this is the case, the process continues with step 750; otherwise, the process continues with step 740.

In the following, a concept is provided for generating a joint state number encoding the state of a plurality of tracks.

Unfortunately, in many cases the range of possible states of a single track is not a multiple of 2 and the binary representation of each state is thus inefficient. For example, if the number of possible states is 5, then we need 3 bits to represent it with a binary number. However, if we have four tracks, each with 5 states, then we have 5×5×5×5=625 states for the whole sub-frame which can be represented by 10 bits (instead of 4×3=12 bits). This corresponds to 2.5 bits per track instead of 3 and we thus obtain a 0.5 bit saving per track or equivalently, 2 bits per subframe (20% of total bit consumption). It is therefore important to combine the states of each track to one joint state, since by this, the inefficiency of the binary representation can be reduced. Note that the same approach could be used to any numbers that are transmitted. For example, since each sub-frame may have a state representing the positions of the pulses, and each frame may, for example. have four sub-frames, these states could be combined to one joint state number.

Given that a sub-frame has, for example, 4 tracks, the bit consumption can be reduced to improve efficiency by jointly encoding the states of each track. For example, given that each track has $p_k$ pulses and each track is of length N, e.g. has N track positions, then the state of each track is in the range 0 to $f(p_k, N)-1$. The states of each track $s_k$ can then be combined to a joint state s of the subframe with the formula (assuming we have 4 tracks per sub-frame)

$$s=[[s_0 f(p_0,N)+s_1]f(p_1,N)+s_2]f(p_2,N)+s_3. \qquad \text{Formula 2}$$

The states of each track can then be determined in the decoder by dividing the joint state by $f(p_k, N)$, whereby the remainder is the state of the last track and the integer part is the joint state of the remaining tracks. If the number of tracks is other than 4, we can readily add or reduce the number of terms in the above equation appropriately.

Note, that when the number of pulses per track is large, then the number of possible states becomes large. For example, with 6 pulses per track with four tracks and a track length N=16, then the state is an 83-bit number, which exceeds the maximum length of binary numbers on regular CPUs. It follows that some extra steps have to be made to evaluate the above formula using standard methods with very long integers.

Observe also that this approach is equal to arithmetic coding of the track states, when the state probabilities are assumed to be equal.

Above, a step-by-step approach has been presented for encoding and decoding pulses information of a track, e.g. the positions, and possibly signs, of pulses of a track. Other embodiments provide another approach, which will be referred to as "split-and-conquer" approach.

A pulse information encoder being configured to apply the split-and-conquer approach, divides a track into two track partitions $x_1$ and $x_2$, which could be considered as two vectors, wherein $x=[x_1\ x_2]$. The basic idea is to encode both vectors $x_1$ and $x_2$ separately, and then to combine the two with the formula $$s(x) = s(x_1) + f(p_1, N_1)s(x_2) + \sum_{k=0}^{p_1-1} f(k, N_1)f(p-k, N-N_1) \qquad \text{Formula 3}$$

In the above equation, it should be noted that $s(x_1)$ and $s(x_2)$ are the states of vectors $x_1$ and $x_2$, when the number of pulses are already known, that is, when the vectors have, respectively, $p_1$ and $p_2=p-p_1$ pulses. To take into account all the states that have 0 to $p_1-1$ pulses in vector $x_1$, we have to add the summation term in the above equation.

The above algorithm/formula can be applied to encode the pulses of interlaced tracks by applying the following two pre-processing steps. Firstly, let the vectors $X_{track\ k}$ consists of all samples on track k and merge these vectors by defining $x=[x_{track\ 1}, x_{track\ 2}, x_{track\ 3}, x_{track\ 4}]$. Observe that this is merely a re-ordering of samples such that all samples from track 1 are placed in the first group and so on.

Secondly, note that the number of pulses per track is usually a fixed number. It follows that if track 1 has $p_1$ pulses, then the number of states on track 1 is $f(k,N_1)=0$ for all values $k\neq p_1$. This is just another way of saying that there are no states for track 1 which do not have $p_1$ pulses. Formally, we can then define the number-of-states formula as:

For a complete track $x_{track\ k}$ with $p_k$ pulses, the number of states is $(N = N_{track\ k})$ — Formula 4

$$f(p, N) = \begin{cases} f(p, N) & \text{for } p = p_k \\ 0 & \text{for } p \neq p_k \end{cases}$$

Otherwise, for $N > 1$ $$f(p, N) = \sum_{k=0}^{p} f(k, N_1)f(p-k, N-N_1)$$

And for $N = 1$:

$$f(p, 1) = \begin{cases} 2 & \text{for } p \geq 1 \\ 1 & \text{for } p = 0. \end{cases}$$

By the re-ordering of samples and using the above definition for the number of states (Formula 4), we can calculate the joint state of all tracks by Formula 3. Note that since the number of states contains mostly zeros, the summation in Formula 3 is zero, when merging the state of tracks. Therefore merging two tracks is identical to Formula 2. Similarly, we can readily show that the merging all four tracks (or five) also gives identical results with both approaches.

According to an embodiment, re-ordering can be used as a pre-processing step to the encoder. In another embodiment, the re-ordering can be integrated into the encoder. Similarly, according to an embodiment, re-ordering can be used as a post-processing step to the decoder. In another embodiment, the re-ordering can be integrated into the decoder.

If the number of pulses on a track is not fixed, we can readily modify the number of states formula appropriately, and still use the same encoding algorithm.

Observe that the approach presented in the section "Combining track data" and the above method give equal results if the order of merging tracks is appropriately chosen. Likewise, also the step-by-step and divide-and-conquer approaches give equal results. We can therefore independently choose which approach to use in the decoder and encoder, according to which is more practical to implement or which approach best fits the computational constraints of the platform.

According to an embodiment, a pulse information encoder algorithm is provided, that can be described in pseudo-code by

```
function state = encode(x)

1. if length of x is 1
    a. if x has no pulses
        i. state = 0
        ii. return
    b. else (x has at least one pulse)
        i. if the pulse(s) in x is positive
            • state = 0
            • return
        ii. else (pulse(s) in x is negative)
            • state = 1
            • return
        iii. end
    c. end
2. else (that is, when length of x is > 1)
    a. split x into two vectors x1 and x2 of length N1 and N2
       respectively
    b. determine state of vector x1 by s1 = encode(x1)
    c. determine state of vector x2 by s2 = encode(x2)
    d. let p be the number of pulses in x and p1 the number of pulses
       in x1
    e. set n0 = 0
    f. for k from 0 to p1−1
        i. set n0 := n0 + f(k,N1)*f(p−k,N2)
    g. end
    h. calculate state as s := s1 + f(p1,N1)*s2 + n0
    i. return
3. end
```

Employing such an encoding algorithm, according to an embodiment, the pulse information encoder is configured to divide one of the tracks into a first track partition and into a second track partition. The pulse information encoder is configured to encode a first substrate number associated with the first partition. Furthermore, the pulse information encoder is configured to encode a second substrate number associated with the second partition. Moreover, the pulse information encoder is configured to combine the first substrate number and the second substrate number to obtain the state number.

Similarly, according to an embodiment, a the pulse information decoder algorithm is provided that can be described in pseudo-code by:

```
function x = decode(s, p, N)

1. if number of pulses p is 0
    a. return vector x full of zeros
2. else
    a. if len is 1
        i. if s == 0
            1. Vector x has p positive pulses at its first position
        ii. else
            1. Vector x has p negative pulses at its first position
        iii. end
    b. else
        i. Choose partition lengths N1 and N2
        ii. Set n0 := 0 and p1 := 0
        iii. While n0 + f(p1,N1)*f(p−p1) < s
            1. set p1 := p1+1
            2. set n0 := n0 + f(p1,N1)*f(p−p1)
        iv. end
        v. set s := s − n0 and p2 := p − p1
        vi. set s1 :=s / f(p1,N1) and the remainder into s2
        vii. decode first partition x1 = decode(s1, p1, N1)
        viii. decode second partition x2 = decode(s2, p2, N2)
        ix. merge partitions x1 and x2 in to x
    c. end
3. end
```

In an embodiment realizing the split-and-conquer approach, a pulse information decoder is configured to generate a first substrate number and a second substrate number based on the state number. The pulse information decoder is configured to decode a first group of pulse positions of a first partition of one of the tracks based on the first substrate number. Moreover, the pulse information decoder is configured to decode a second group of pulse positions of a second partition of the one of the tracks based on the second substrate number.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet or over a radio channel.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for decoding an encoded audio signal, wherein one or more tracks are associated with the encoded audio signal, each one of the tracks comprising a plurality of track positions and a plurality of pulses, wherein the apparatus comprises:

a pulse information decoder for decoding a plurality of pulse positions, wherein each one of the pulse positions is one of the track positions, where one of the pulses is located, and wherein the pulse information decoder is configured to decode the plurality of pulse positions by only using one track position number, one total pulse number and one state number, wherein the track position number indicates a total number of the track positions of at least one of the tracks, and wherein the total pulse number indicates a total number of the pulses of at least one of the tracks; and a signal decoder for decoding the encoded audio signal by generating a synthesized audio signal using the plurality of pulse positions and a plurality of predictive filter coefficients being associated with the encoded audio signal, wherein at least one of the pulse information decoder and the signal decoder comprises a hardware implementation, wherein the pulse information decoder is furthermore adapted to decode a plurality of pulse signs by only using the track position number, the total pulse number and the state number, wherein each one of the pulse signs indicates a sign of one of the plurality of pulses, and wherein the signal decoder is adapted to decode the encoded audio signal by generating a synthesized audio signal furthermore using the plurality of pulse signs.

2. An apparatus according to claim 1, wherein at least a last track and one or more other tracks are associated with the encoded audio signal, and wherein the pulse information decoder is adapted to generate a first substrate number and a second substrate number from the state number, wherein the pulse information decoder is configured to decode a first group of the pulse positions based on the first substrate number, and wherein the pulse information decoder is configured to decode a second group of the pulse positions based on the second substrate number, wherein the second group of the pulse positions only comprises pulse positions indicating track positions of the last track, and wherein the first group of the pulse positions only comprises pulse positions indicating track positions of the one or more other tracks.

3. An apparatus according to claim 2, wherein the pulse information decoder is configured to generate the first substrate number and the second substrate number by dividing the state number by $f(p_k, N)$ to acquire an integer part and a remainder as a division result, wherein the integer part is the first substrate number and wherein the remainder is the second substrate number, wherein $p_k$ indicates for each one of the one or more tracks the number of pulses, and wherein N indicates for each one of the one or more tracks the number of track positions.

4. An apparatus according to claim 1, wherein the pulse information decoder is adapted to conduct a test comparing the state number or an updated state number with a threshold value.

5. An apparatus according to claim 4, wherein the pulse information decoder is adapted to conduct the test by comparing, whether the state number or an updated state number is greater than, greater than or equal to, smaller than, or smaller than or equal to the threshold value, and wherein the pulse information decoder is furthermore adapted to update the state number or an updated state number depending on the result of the test.

6. An apparatus according to claim 5, wherein the pulse information decoder is configured to compare the state number or the updated state number with the threshold value for each track position of one of the plurality of tracks.

7. An apparatus according to claim 1, wherein the pulse information decoder is configured to divide one of the tracks into a first track partition, comprising at least two track positions of the plurality of track positions and into a second track partition comprising at least two other track positions of the plurality of track positions, wherein the pulse information decoder is configured to generate a first substrate number and a second substrate number based on the state number, wherein the pulse information decoder is configured to decode a first group of pulse positions associated with the first track partition based on the first substrate number, and wherein the pulse information decoder is configured to decode a second group of pulse positions associated with the second track partition based on the second substrate number.

8. An apparatus for encoding an audio signal, comprising:

a signal processor for determining a plurality of predictive filter coefficients being associated with the audio signal, for generating a residual signal based on the audio signal and based on the plurality of predictive filter coefficients; and a pulse information encoder for encoding a plurality of pulse positions relating to one or more tracks, to encode the audio signal, the one or more tracks being associated with the residual signal, each one of the tracks comprising a plurality of track positions and a plurality of pulses, wherein each one of the pulse positions is one of the track positions, where one of the pulses is located, wherein the pulse information encoder is configured to encode the plurality of pulse positions by generating one state number, such that the pulse positions are decodable only based on the state number, one track position number, and one total pulse number, wherein the track position number indicates a total number of the track positions of at least one of the tracks, and wherein the total pulse number indicates a total number of the pulses of at least one of the tracks, wherein at least one of the signal processor and the pulse information encoder comprises a hardware implementation, wherein the pulse information encoder is configured to determine the state number depending on an intermediate sum, wherein, for each pulse at a track position for each track position of one of the tracks, the pulse information encoder is configured to add an integer value to the intermediate sum, to update the intermediate sum.

9. An apparatus for encoding according to claim 8, wherein the pulse information encoder is adapted to encode a plurality of pulse signs, wherein each one of the pulse signs indicates a sign of one of the plurality of pulses, wherein the pulse information encoder is configured to encode the plurality of pulse signs by generating the state number, such that the pulse signs can be decoded only based on the state number, the track position number indicating a total number of the track positions of at least one of the tracks, and the total pulse number.

10. An apparatus according to claim 8, wherein the pulse information encoder is configured to add the integer value to the intermediate number for each pulse at a track position for each track position of one of the tracks, to acquire the state number, wherein the integer value is defined by $f(p, k-1)$, wherein p indicates a number of found pulses, wherein k indicates a track position, and wherein $f(p, N)$ indicates the number of possible configurations for a track comprising N track positions and p signed pulses.

11. An apparatus according to claim 8, wherein the pulse information encoder is configured to divide one of the tracks into a first track partition, comprising at least two track positions of the plurality of track positions, and into a second track partition, comprising at least two other track positions of the plurality of track positions, wherein the pulse information encoder is configured to encode a first substrate number associated with the first partition, wherein the pulse information encoder is configured to encode a second substrate number associated with the second partition, and wherein the pulse information encoder is configured to combine the first substrate number and the second substrate number to acquire the state number.

12. Method for decoding an encoded audio signal, wherein one or more tracks are associated with the encoded audio signal, each one of the tracks comprising a plurality of track positions and a plurality of pulses, wherein the method comprises:

decoding a plurality of pulse positions, wherein each one of the pulse positions is one of the track positions, where one of the pulses is located, and wherein the plurality of pulse positions are decoded by only using one track position number, one total pulse number and one state number, wherein the track position number indicates a total number of the track positions of at least one of the tracks, and wherein the total pulse number indicates a total number of the pulses of at least one of the tracks, decoding a plurality of pulse signs by only using the track position number, the total pulse number and the state number, wherein each one of the pulse signs indicates a sign of one of the plurality of pulses, and decoding the encoded audio signal by generating a synthesized audio signal using only the plurality of pulse positions and a plurality of predictive filter coefficients being associated with the encoded audio signal, wherein decoding the encoded audio signal is conducted by generating a synthesized audio signal furthermore using the plurality of pulse signs.

13. Method for encoding an audio signal, comprising:

determining a plurality of predictive filter coefficients being associated with the audio signal, for generating a residual signal based on the audio signal and based on the plurality of predictive filter coefficients; and encoding a plurality of pulse positions relating to one or more tracks, to encode the audio signal, the one or more tracks being associated with the residual signal, each one of the tracks comprising a plurality of track positions and a plurality of pulses, wherein each one of the pulse positions is one of the track positions, where one of the pulses is located, wherein the plurality of pulse positions are encoded by generating one state number, such that the pulse positions can be decoded only based on the state number, one track position number, and one total pulse number, wherein the track position number indicates a total number of the track positions of at least one of the tracks, and wherein the total pulse number indicates a total number of the pulses of at least one of the tracks, wherein determining the state number depending on an intermediate sum, wherein, for each pulse at a track position for each track position of one of the tracks, an integer value is added to the intermediate sum, to update the intermediate sum.

14. A non-transitory computer readable medium comprising a computer program implementing the method of claim 12 when being executed on a computer or signal processor.

15. A non-transitory computer readable medium comprising a computer program implementing the method of claim 13 when being executed on a computer or signal processor.

* * * * *